United States Patent [19]

Talcott et al.

[11] Patent Number: 5,052,337

[45] Date of Patent: Oct. 1, 1991

[54] LENS DYEING METHOD AND APPARATUS COMPRISING HEATING ELEMENT CONTACTING DYEING TANK, HEAT CONTROLLER AND SENSOR FOR DYE SOLUTION TEMPERATURE

[76] Inventors: Thomas D. Talcott, 17 Pacific Coast, Laguna Niguel, Calif. 92667; James J. Ryan, III, 27143 Sunnyridge, Palos Verdes, Calif. 90274; John L. Jones, Jr., 960 N. Enterprise, Orange, Calif. 92667

[21] Appl. No.: 264,690

[22] Filed: Oct. 31, 1988

[51] Int. Cl.[5] ..... B05C 11/00; D06P 1/90; G02C 7/02

[52] U.S. Cl. ..... 118/667; 8/506; 8/611; 8/636; 8/148; 68/15; 118/400; 118/429; 118/620; 118/666; 351/159; 351/162

[58] Field of Search ..... 8/506, 611, 636; 118/667, 400, 429, 620

[56] References Cited

U.S. PATENT DOCUMENTS

| | | | |
|---|---|---|---|
| 4,245,991 | 1/1981 | Haddad et al. | 8/506 |
| 4,377,389 | 3/1983 | Haddad et al. | 8/506 |
| 4,426,569 | 1/1984 | Miller et al. | 118/667 |
| 4,442,788 | 4/1984 | Weis | 118/405 |
| 4,490,495 | 12/1984 | Weber | 8/506 |
| 4,531,947 | 7/1985 | Engelhardt | 8/495 |
| 4,632,055 | 12/1986 | Ryder et al. | 118/429 |
| 4,661,117 | 4/1987 | Wilson et al. | 8/506 |
| 4,710,199 | 12/1987 | Suter | 8/507 |
| 4,780,103 | 10/1988 | Minowa | 8/509 |
| 4,812,142 | 3/1989 | Brodmann | 8/512 |
| 4,828,571 | 5/1989 | Pensa et al. | 8/492 |
| 4,915,986 | 4/1990 | Elias et al. | 118/425 |

OTHER PUBLICATIONS

Surfacing and Finishing, vol. XVIV, No. 11 (Jul. 1986) pp. 65–75.

BPI ® 1988 Catalog (Brain Power, Inc., 4470 S.W. 74th Avenue, Miami, Fla.) pp. 9–35.

20/20 (Dec. 1988) p. 56.

*Primary Examiner*—A. Lionel Clingman

*Attorney, Agent, or Firm*—Knobbe, Martens, Olson & Bear

[57] ABSTRACT

An apparatus and process for tinting plastic material; specifically, polycarbonate and other plastic eyeglass lenses. The dye solution has an elevated boiling point which allows for dyeing of the material at rates and temperatures above 212 degrees F. The dye solution temperature is maintained and controlled within a pre-selected tolerance by a temperature controlling unit and its associated heater, which is affixed to the dyeing tank. Dye solution is agitated and dispersed by a stirrer and stirring apparatus, and dye solution level is maintained by an automatic fill apparatus.

1 Claim, 3 Drawing Sheets

Fig. 1
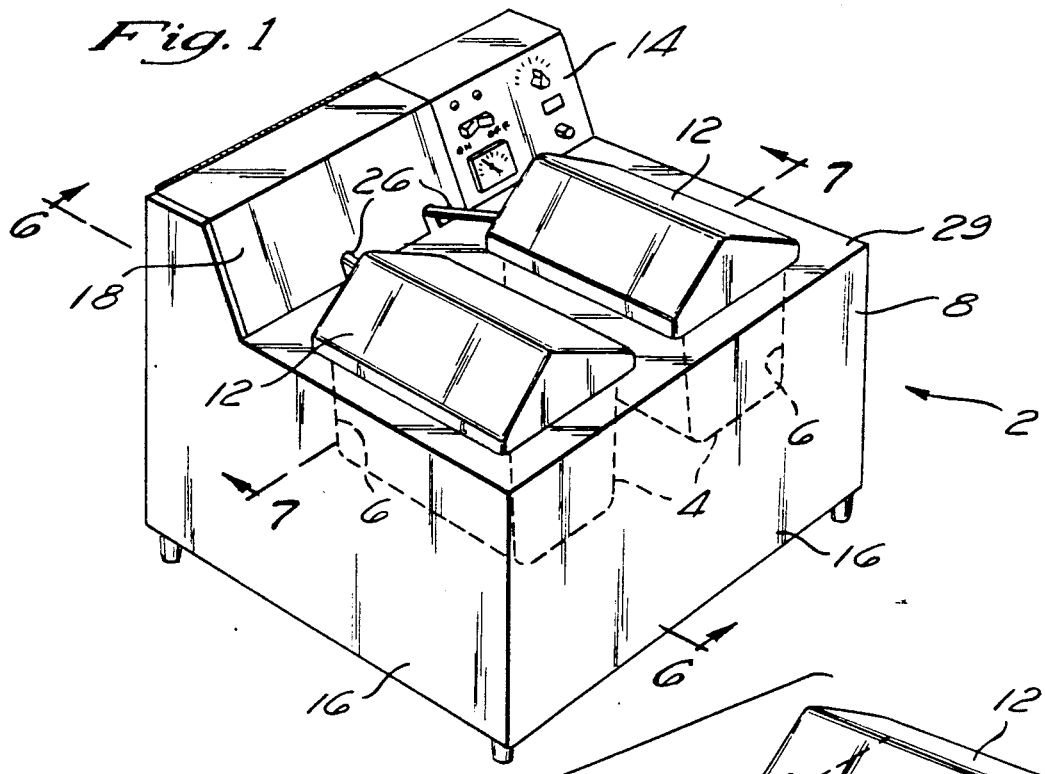
Fig. 2
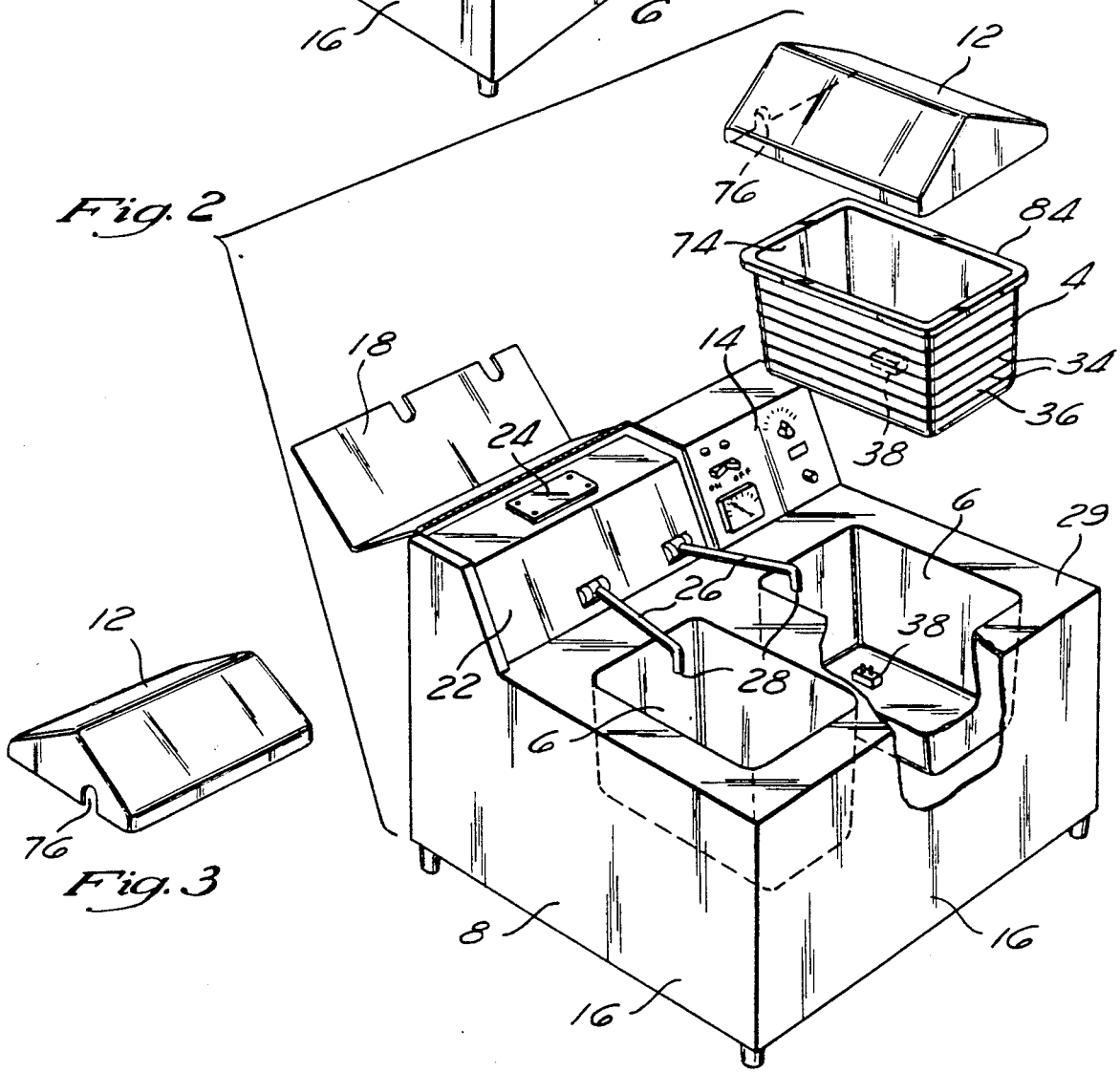
Fig. 3

LENS DYEING METHOD AND APPARATUS COMPRISING HEATING ELEMENT CONTACTING DYEING TANK, HEAT CONTROLLER AND SENSOR FOR DYE SOLUTION TEMPERATURE

BACKGROUND OF THE INVENTION

This invention relates to an apparatus and process for tinting plastic material and more specifically, for tinting polycarbonate and other plastic eyeglass lenses Presently, eyeglass lenses are made from either glass or plastic. Plastic lenses have advantages over glass in that they are lighter and can be easily tinted by an optical laboratory using procedures well known in the art.

The advent of the development of clear plastic materials such a plexiglass offered the manufacture and use of light weight eyeglass lenses. The main disadvantage was that of scratching of the surface of the lens rendering them opaque.

PPG has marketed CR-39 (diethylene glycol bis(allyl carbonate) monomer for over a decade for the manufacture of plastic eyeglass lenses. CR-39 exhibits the best abrasion resistance and hardness of all plastics considered for use in eyeglass lenses. The impact resistance is carefully controlled to pass FDA impact specifications. Improvements have been made in commercial lenses with the addition of hard abrasion resistant coatings. Silicone (silica/silane) heat cured coatings and acrylic ester ultraviolet light cured coatings are used. Hard coats are preferred on the front surface of the lens but are often not used on the back surface of a prescription lens. The CR-39 surface also tints with relative ease using disperse dyes prepared especially for this use at moderate temperatures. The extremely hard coatings however have much less affinity for tint.

Polycarbonate (a thermoplastic) supplied by General Electric (Lexan TM) and others has the unique advantage of high refractive index which allows for the use of thinner lenses, lighter lenses. Optical lenses made from this material are more comfortable in that there is less strain due to the weight of the lenses on a wearer's nose and ears. It is also much more resistant to impact and is truly a shatterproof safety lens. It is however so soft that it cannot be used without a hard coating on both the front and back surfaces. An additional reason for coating polycarbonate lenses is that the polycarbonate surface will not absorb the same tints that are used commercially for the higher volume CR-39 lenses.

More recently many other high refractive index thermoplastic and thermoset lens have appeared in the marketplace. Although many are currently recommended for use without hard coatings most are softer than uncoated CR-39 and additional use will dictate the use of hard coatings.

The lens manufacturer generally produces plastic lens blanks with a finished front surface as described above. An optical laboratory then shapes, fines and polishes the prescription into the rear surface. In the case of the softer lenses a hard coating is then applied. The coating selected may be very hard and abrasion resistant if a clear lens or only a fashion tint is desired. In general a less abrasion resistant specially formulated material is required as a coating if a sunglass depth of tint is desired. The lens is generally edged after coating and then tinted to the desired color and depth of tint.

The tinting operation is the most time consuming operation in an optical laboratory.

Heatable tanks used in the plastics dyeing process are well known. A conventional heatable dyeing tank includes heating elements positioned in the bottom of an outer tank. Such elements are in contact with a heat transfer media, into which the dyeing tanks are placed. The tank is heated by conduction of the heat transferred from the heating elements to the tank via a heat transfer media such as silicone or polyethylene glycol, and then to the outer surfaces of the tanks.

To use the tank, a holder containing lens material to be dyed is positioned into the dyeing tank. The commonly used methods and apparatus for dyeing lens material use a dyeing tank whose heater output can be set at a variety of temperatures.

The general directions for using tints recommend using a temperature range of 190 to 205 deg. F. The available apparatus however will not control to such tight tolerances. Current tints boil at approximately the same temperature as water 212 deg. F. Covers are supplied with the apparatus to slow the evaporation of water when tinting is not being performed.

Because of the nature of the heating mechanism of current equipment the operator must choose whether to use the covers or not. If the operator chooses to use covers then the heat transfer fluid must be close to 212 deg. F. to prevent boil over. When the covers are removed to allow placement of a lens in the bath the temperature will drop quickly (20 minutes) to about 170 to 175 deg. F. At this low a temperature tinting of the harder lenses and coatings essentially ceases. If one operates the heat transfer fluid at about 238 deg. F., a bath temperature of 194 Deg. F. can be maintained with the covers off. Evaporation of water is severe. If the covers are placed on the tint tanks a boilover will occur in 7 minutes.

Additionally, the evaporative loss of water from the open dyeing tanks requires the manual addition of fill water to the dyeing tanks by the operator. Maintenance of an improper level of dye solution due to irregular or infrequent water replenishment by the operator may also affect the bath temperature, time and efficiency of the lens dyeing process.

Under current methodology, CR-39 plastic lenses are tinted by the following procedure. After finishing, the lenses are dipped in a dye solution. The duration of time the lens is submerged in the dye solution determines the degree to which the lens is tinted. If harder surfaced lenses are required, some optical laboratories coat the lens to provide greater scratch resistance. The coating is then the surface that absorbs the tint. All of the optical laboratories, as well as many retail outlets, are set up to perform the above-described tinting procedure.

Many conventional dye stuffs can be used for the purpose of this invention. Many "disperse dyes" and mixtures thereof have been found satisfactory. Disperse dyes are actually very fine particles of the chemical color. The color is then absorbed from these particles. Examples of such disperse dyes include Disperse Blue #3, Disperse Blue #14, Disperse Yellow #3, Disperse Red #13 and Disperse Red #17. The classification and designation of the dyes recited in this specification are based on "The Color Index," 3rd edition, published jointly by the Society of Dyes and Colors and the American Association of Textile Chemists and Colorists (1971). Chemical identities of the above-mentioned dye stuffs can be found in that publication. Dye stuffs can generally be used either as a sole dye constituent or as a component of a dye mixture depending upon the color desired.

A typical dye concentration in the bath is 2% by weight, but there is a considerable latitude in this regard. Generally, dyes may be present in the water dispersion at a level of about 0.2 to 15%, preferably 1 to 4%, based on the total weight of dye solution. Where a dye mixture is used and the rates of consumption of the individual dyes are different, dye components will have to be added by immersing the lens in the color that has been depleted. The tints are normally discarded after about a week of use.

Additionally, commercially available dyes are presently mixed with distilled water. These dye dispersions, therefore, have a boiling point of 212° F. (or 100° C.). As is well known in the art, a 10° C. increase in dye temperature at this level produces a substantial increase in dye affinity to the lens material, but the present limiting factor is the boiling point of the solution comprised of distilled water, combined with the presently available commercial plastic dyes.

The conventional dyes are formulated to initially disperse evenly throughout a dyeing solution, but as the dye solution sits within the dyeing tank, the dispersion of dye pigment typically begins to settle out and collect on the bottom of the dyeing tank. This settling out of the dye particles, in conjunction with the elevated temperature of the bottom of the dyeing tank, produces a coagulation or charring of the dye particles, thereby reducing the effectiveness of the dye and requiring early replacement of the dye or tint.

SUMMARY OF THE INVENTION

The method and the dye bath composition of this invention are particularly useful for dyeing CR-39 lenses and softer plastic lenses that have been coated with a variety of hard, abrasion resistant coatings.

An apparatus and method for dyeing plastic eyeglass lens material is described herein. The apparatus includes a thermally conductive dyeing tank which has in close contact to it an electrical heating element, preferably comprised of a silicon wrapped nichrome wire, which maintains the temperature of a dye solution within the dyeing tank to within a preselected tolerance. The temperature of the dye solution is monitored by a temperature sensor, connected to a heater control which is responsive to the input of the sensor. The heater control adjusts the electrical current supplied to the heater to maintain a preselected temperature within a preselected tolerance. Additionally, the dyeing tank has associated with it a stirring device, preferably comprising a magnetic stirrer and its associated shield, along with an apparatus that maintains a preselected level of dye solution automatically within the dyeing tank. Both the stirrer and the apparatus for maintaining the preselected dye solution level enhance consistent heating and dispersion of the dye particles.

The present invention uses a unique, elevated boiling point dye solution which allows for dyeing of the lens materials at rates and times faster than with commercially available dyes.

The method associated with this apparatus comprises the use of a dye solution which is composed to elevate its boiling point to produce a more rapid and efficient dyeing of the lens material.

The dye solution is used in conjunction with the dyeing tank which provides heat input to the dye solution to maintain it at a preselected temperature within a predetermined tolerance. The heat input is provided by a heater directly attached to the dye tank which, in conjunction with a temperature sensor contained within the dye solution.

The present invention alleviates the lag in temperature control of the dyeing solution normally caused by opening the tank lid or placing cold lenses in the tank. This is accomplished by having the heater element firmly affixed to the dye tank itself, allowing instantaneous compensation of temperature through the direct proximity of the heating elements to the dye tank and dye solution. Also, temperature sensing and controlling means are provided to allow the maintenance of a predetermined dye solution temperature within a select tolerance. In addition, an automatic water fill apparatus is associated with the dyeing tank to maintain the dye level without operator intervention.

The present invention describes a stirrer and stirring apparatus for agitating and dispersing the dye pigment throughout the dye solution as to alleviate any charring or settling out of the dye particles within the dyeing tank.

DESCRIPTION OF THE DRAWINGS

FIG. 1 is a perspective view of the lens dyeing apparatus.

FIG. 2 is an exploded perspective view of the lens dyeing apparatus.

FIG. 3 is a rotated perspective view of the lid of the tank depicted in FIG. 2.

DETAILED DESCRIPTION OF THE INVENTION AND OF THE PREFERRED EMBODIMENT

Figure 4:
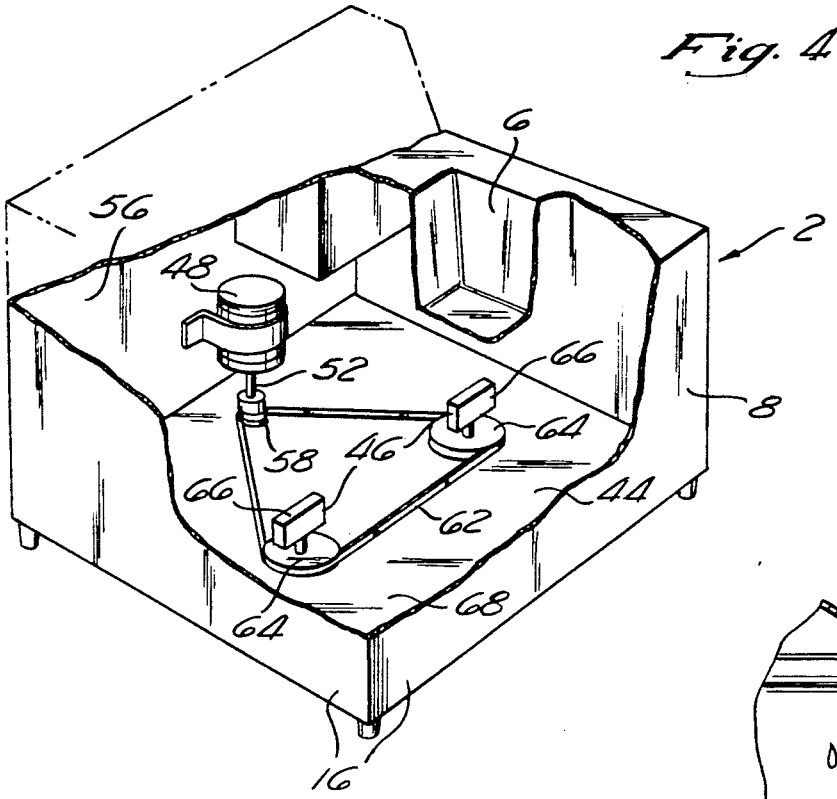
FIG. 4 is a cut-out view of the lens dyeing apparatus, depicting only the electrical motor and connected magnetic stirrers.

The plastic material to be dyed, in accordance with the method and apparatus of the invention, may be used for a variety of purposes. Preferably the plastic material will be eyeglass lens material to be used for sunglasses. Such plastics used with the aforementioned methods and apparatus are plastics including cellulosic plastics, polycarbonate-type plastics, polyacrylic plastics, epoxy plastics, polyvinyl chloride-type plastics, polystyrene-type plastics and polyester-type plastics. Most preferably, polycarbonate-type plastics such as diethylene glycol bisallyl carbonate (CR-39), thermoplastic polycarbonates and the newer, high refractive index plastics may be used with the instant invention.

A commercially available dye solution may be used with the aforementioned method and apparatus. Preferably, the dye solution will also include between 1 and 50% of a polyhydric alcohol, or other solute most preferably 20%. The polyhydric alcohol may comprise alcohol such as diethylene glycol, triethylene glycol, glycerine or sorbitol, which are obtained by the addition of 1 to 5 ethylene oxides to the individual hydroxyl groups, and are possessed of ethylene oxide chains having a molecular weight of 100 to 2,000. Preferably, the polyhydric alcohol used will be glycerine.

The addition of the polyhydric alcohols or other solute to the dye solution provides an elevated boiling point for the dyeing solution, thereby increasing the temperature of dyeing. Preferably, the dyeing solution will have a boiling point between 212° F. and 230° F. The composition and characteristics of the dye solution used in conjunction with the methods and apparatus of the invention are important in providing optimal and timely dyeing of the lens material. Generally, the dyeing solution should have a boiling point elevated above that of water, and the dye composition should thereby have an increased affinity for the lens material.

The precise maintenance and control of the temperature of the dyeing solution within the dyeing tank in conjunction with the modified dye solution is important in providing optimal and timely lens dyeing. The temperature of the dyeing solution of this invention may be controlled using a temperature controller which accepts thermistor or thermocouple sensor input from within the dye bath.

Such a temperature controller may comprise an on/-off cycling control over the power input to the heater source, with the on cycle being used more frequently under conditions where additional heating is required. Preferably, the temperature controller will comprise a proportional band controller which will proportionately increase power input to the heater device in proportion to the amount of temperature increase or decrease of the dye solution itself. Such a proportional band temperature controller may be obtained from Watlow Winona, Inc., Model No. 201. Most preferably, the temperature controller will have associated with heating means to precisely hold the dye solution temperature at a predetermined temperature figure. Additionally, the temperature controller may hold the temperature within a predetermined tolerance, preferably, a tolerance of ±1.5° F., and most preferably a tolerance of ±0.5° F.

FIGS. 1 and 2 depict an apparatus 2 for the dyeing of lens material. The apparatus 2 has associated with it a number of dyeing tanks, preferably between 1–12 tanks, and most preferably between 2–8 tanks. The apparatus comprises two tanks 4, each of which is fitted into an opening 6 within the top of the support frame 8 of the apparatus 2, such tanks 4 depicted as covered with their associated lids 12. FIG. 3 depicts such an associated lid 12. Such lids 12 may be produced of a plastic or metal substance; preferably a metal substance such as stainless steel, and may be of a tent-like configuration as to allow for reflux of boiling dyeing solution, the dyeing solution condensing on the inner surfaces of the top of the lid 12, and refluxing back into the dyeing tank 4.

The apparatus 2 also has associated with it a variety of controls and gauges 14 which monitor a variety of functions of the apparatus. These controls and gauges may comprise on-off switches, indicator lights, stirring speed controls, temperature gauges, and heater power indicators.

The outer walls 16 and support frame 8 of the dyeing apparatus 2 may be constructed of plastic or stainless steel, preferably stainless steel and most preferably a corrosion-resistant, temperature resistant stainless steel surrounding the top, bottom and sides of the apparatus.

Attached to the support frame 8 is a hinged cover 18, which provides access to a water reservoir tank 22. Such a tank 22 may have associated with its electronic or mechanical means of sensing the dye solution level within the dyeing tanks in conjunction with means for replenishing the water supply when the dye solution level is depleted to a predetermined level through water evaporation. Preferably, the water reservoir tank 22 is constructed of a plastic material, such tank 22 having an air-tight opening 24 into which water can be placed to replenish the reservoir 22 water level.

Attached to the water reservoir tank 22 are one or more conduits 26 which are in fluid communication with the dye solution contained within the dyeing tanks 4 when the solution is at a predetermined, operational level within the dyeing tanks 4, and provide the only outside opening for air or water exchange within the water reservoir tank 22 or associated conduits 26.

In the event that the dye solution level within the tank 4 falls below the predetermined, operational level, the open end 28 of the conduit 26 will no longer be in fluid communication with the dye solution, but a layer of air will lie between the open end 28 of the conduit 26 and the dye solution. The air layer will permit bubbles to travel up the conduit 26 to the tank 22 to displace water contained within the tank 22 by air, thereby releasing water from the open end 28 of the conduit 26 into the dyeing tank 4. This process repeats itself until the end of the conduit 26 is again immersed in the dye solution.

On the upper surface of a platform 29 of the support frame 8 is located the dyeing tank 4. The tank 4 may be rectangular and is preferably made of materials (e.g., stainless steel, porcelain, sintered A1203), or similar heat resistant materials that can withstand temperatures greater than the maximum output of the temperature control system.

Figure 5:
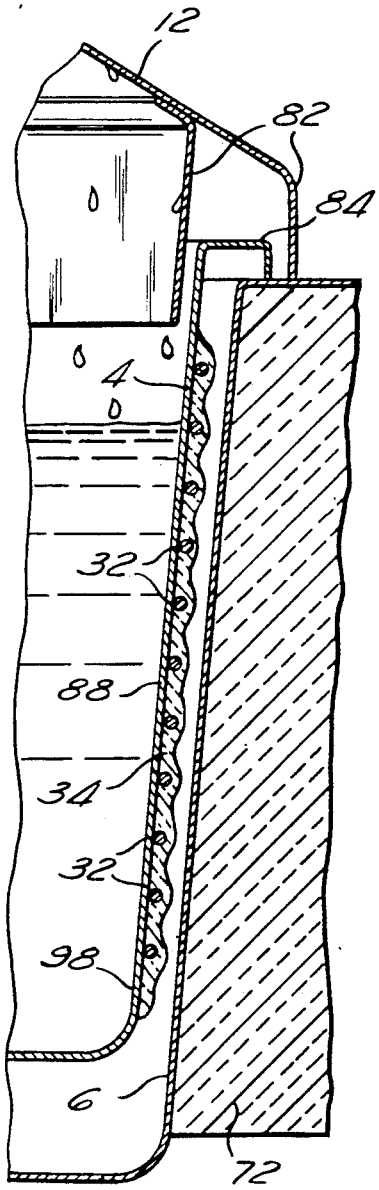
FIG. 5 is an enlarged, frontal, sectional view of the dyeing tank and its associated lid.
Figure 6:
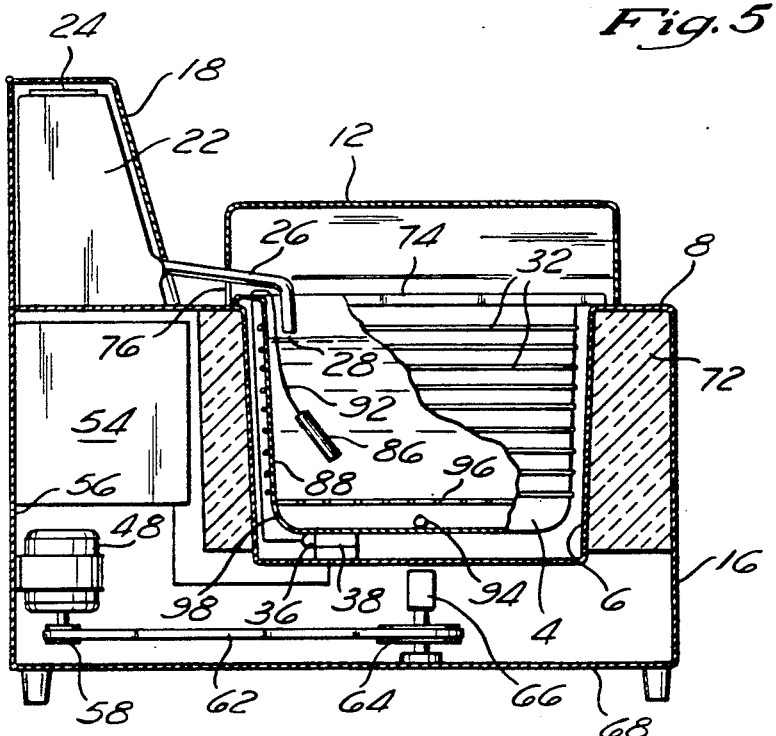
FIG. 6 is an elevational, sectional, side view of the lens dyeing apparatus taken along line 6—6 of FIG. 1, depicting one of the dyeing tanks.

As shown in FIGS. 5 and 6, the heating coils 32 are wrapped directly around the dyeing tank 4. The coils 32 are preferably made of nichrome (chromium-nickel) wire, but other electrical resistance materials capable of attaining high temperatures can be used. These nichrome coils are preferably affixed in proximity to each other, and to the dyeing tank via a silicone coating 34.

The coils 32 of the present invention preferably allow maximal heat transfer from the heating coils 32 to the dye solution. Additionally, since the coils 32 are preferably arranged to produce an even heat distribution over the entire outer surface of the dyeing tank 4, localized overheating may be minimized, thereby allowing accurate temperature control of the dye solution.

The silicone-coated nichrome coils 32 can be obtained as pad heaters from Watlow Winona Inc. The coils 32 are rated at 300–500 watts for 120 volt operation for one quart sized tanks. A preferred wattage for the coils 32 has been found to be 350–450 watts, such wattage allowing satisfactory results for dye temperature control in the present invention. The leads 36 may enter the base end of the tank and are connected by a coupling 38 to the temperature control circuitry 54 in FIG. 6.

Referring to FIG. 4, the support frame 8 provides a platform 44 for a magnetic stirrer 46. An adjustable speed electric motor 48 and vertical shaft 52 may be positioned below the temperature controller 54 and affixed to the back wall 56 of the support frame 8. Affixed to the vertical shaft 52 is a pulley 58 connected to a drive belt 62 which connects with two other pulleys 64. Magnets 66 are affixed to the top of the pulleys 64. The magnets 66 may be mounted perpendicularly to the pulleys 64, such that rotation of the shaft 52 by the motor 48 causes the pulley 64 attached magnets 66 to spin in a plane parallel to the tank bottom 68.

Referring to FIGS. 6 and the leads 36 of the heating coils 32 are electrically connected to the temperature controller 54 located beneath the water reservoir 22. Thus, the electrical connections are protected from mechanical and thermal effects present above the tank 4. Heat insulating material 72 may surround the tanks 4. The insulation 72 is preferably resistant to moisture and heat, and also serves to reflect heat emanating outwardly from the coils 32 back towards the dyeing tank 4. The insulation 72 also protects the motorized magnets 66 from heat produced by the coils 32.

A lid 12 is supplied to cover the top 74 of the tank 4. The lid 12 is preferably comprised of stainless steel and most preferably of a tent shape. An opening 76 may be provided in the corner of the lid 12, as shown in FIG. 3, to allow the water conduit 26 to extend into the dyeing tank 4. The tank 4 is additionally insulated by the lid 12. The lid 12 may additionally keep heat within the dyeing tank 4 and increase the safety of the apparatus 2 by providing protection from boil-over.

FIG. 5 represents a preferred configuration of the lid 12 and dyeing tank 4 which allows the refluxing of the dye solution as it condenses on the inner portions of the lid 12 and refluxes as droplets down into the dyeing tank 4. This cross-sectional view also depicts in detail the close association of the silicone coated nichrome wires 34 on outside of the dyeing tank 4, along with the placement and configuration of the edges 82 of the lid 12 with respect to the outer rim 84 of the dyeing tank 4, such placement and configuration preventing reflux outside of the dyeing tank 4, and conserving the dye solution by reducing its evaporation into the environment.

Figure 7:
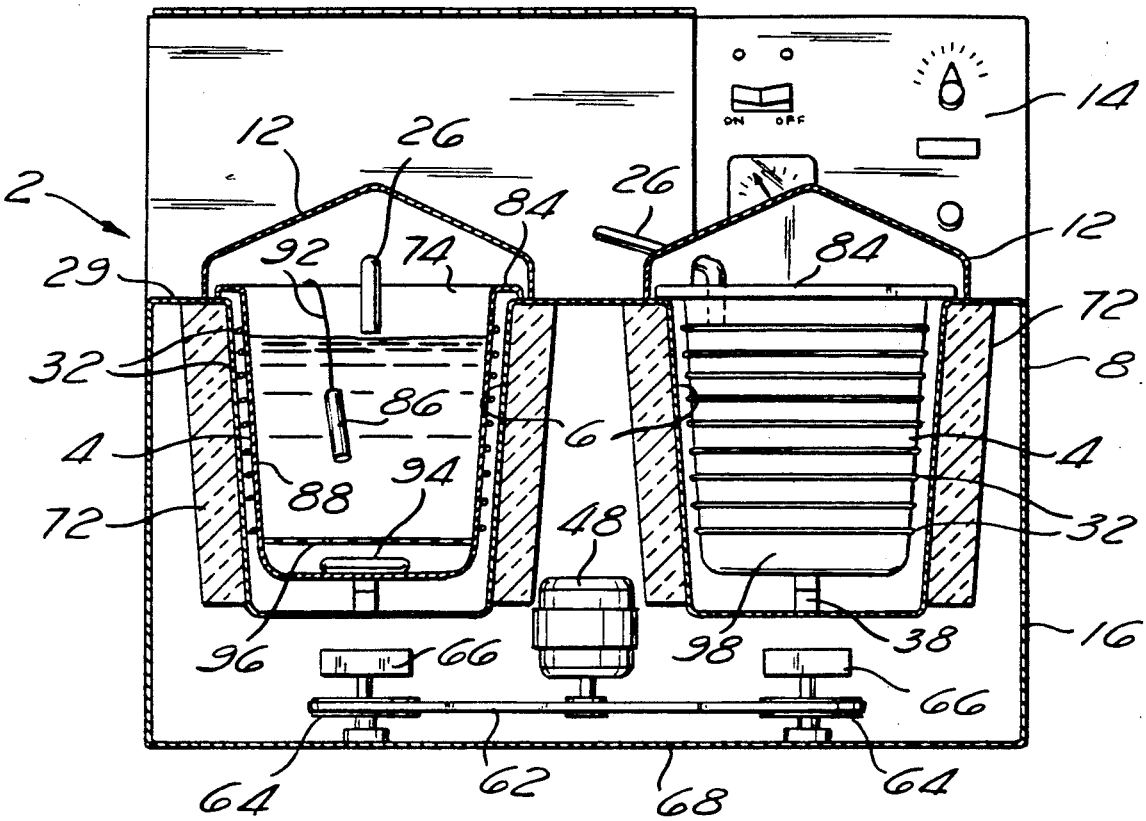
FIG. 7 is a frontal, sectional view of the lens dyeing apparatus taken along line 7—7 of FIG. 1, depicting the dyeing tanks.

Referring to FIGS. 6 and 7, the apparatus has associated with it a temperature sensor 86, preferably comprising a thermistor probe. Such sensor 86 may be directly associated with the inner wall 88 of the dyeing tank 4, or hang inside the dyeing tank 4. The sensor 86 is connected to the temperature controller 54 by an associated lead 92 from the outside of the dyeing tank 4. Preferably, the dye solution temperature sensor 86 has a relatively short time constant to provide optimal sensing of temperature changes within the dyeing tank 4.

FIGS. 6 and 7 also depict the operational mode of the apparatus. A stirring bar 94. of appropriate size to allow for optimal heating and dye mixing, is placed within the tank 4. The stirring bar 94 is generally cylindrical, made of steel and has a coating of vitreous carbon or polytetrafluoroethylene. A protective cover 96 is then placed into the dyeing tank 4, on top of the stirring bar 94, allowing sufficient clearance and porosity as to allow the stirring bar 94 to function in its desired manner. The lid 12 is placed over the dyeing tank 4 with the outer rim 84 of the tank 4 extending above and over the edge of the support frame 8. The electric motor 48 is then energized to rotate the permanent magnets 66 which in turn results in rotation of its magnetic field. The rotating field causes the stirring bar 94 contained within tank to spin, resulting in the contents of the tank 4 being stirred.

Figure 8:
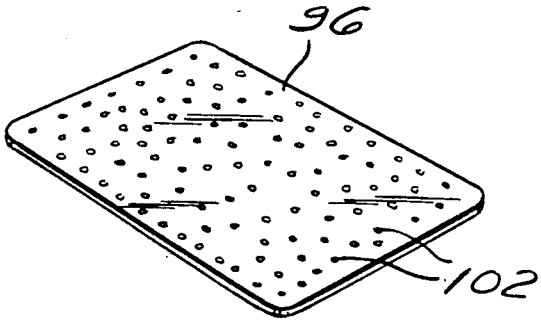
FIG. 8 is a perspective view of the protective cover for the steering magnet.

FIG. 8 depicts a protective cover 96 for placement over the magnetic stirrer 94 within the dye tank apparatus 2. The cover 96 may be constructed such that it fits snugly down into the tapered bottom 98 of the dyeing tank 9, yet stops at a point as to provide clearance for the magnetic stirrer 94. The protective cover 96 may be comprised of a variety of materials such as plastic or metal, preferably a temperature and dye-resistent metal, and is most preferably configured with a plurality of holes and/or openings 102 for the contemplated protection of the lens material, but not to interfere with the stirring and agitating properties of the magnetic stirrer 94.

We claim:

1. An apparatus for the high speed dyeing of plastic eyeglass lens material in a dye solution which is maintained throughout the dyeing operation at substantially its boiling point, comprising:

a thermally conductive dyeing tank for holding a dye solution and sized to receive lens material to be dyed;

a lid for covering said dyeing tank;

an electrical heating element in direct contact with the exterior of said dyeing tank;

a sensor for detecting the temperature of said dyeing solution within said dyeing tank; and a heater control responsive to said sensor for adjusting the electrical current supplied to said electrical heating element to maintain a preselected temperature at substantially the boiling point of said dye solution throughout the dyeing operation, said heater control operating to:

provide a first electrical current level to said heating element when said lid is covering said dyeing tank, and provide a second electrical current level, higher than said first electrical current level, to said heating element when said lid is removed from said dyeing tank.

* * * * *